US008172736B2

(12) United States Patent
Contreras

(10) Patent No.: US 8,172,736 B2
(45) Date of Patent: May 8, 2012

(54) EXERCISE APPARATUS AND METHODS OF USE

(76) Inventor: Bret Contreras, Scottsdale, AZ (US)

( * ) Notice: Subject to any disclaimer, the term of this patent is extended or adjusted under 35 U.S.C. 154(b) by 0 days.

(21) Appl. No.: 13/284,954

(22) Filed: Oct. 30, 2011

(65) Prior Publication Data

US 2012/0058870 A1 Mar. 8, 2012

Related U.S. Application Data

(62) Division of application No. 12/299,167, filed as application No. PCT/US2007/088190 on Dec. 19, 2007.

(60) Provisional application No. 60/870,828, filed on Dec. 19, 2006, provisional application No. 60/870,839, filed on Dec. 19, 2006, provisional application No. 60/885,346, filed on Jan. 17, 2007.

(51) Int. Cl.
*A63B 26/00* (2006.01)

(52) U.S. Cl. ..... 482/142; 482/140; 482/907

(58) Field of Classification Search ..... 482/25, 482/41, 140–147, 907, 908
See application file for complete search history.

(56) References Cited

U.S. PATENT DOCUMENTS

| | | | | |
|---|---|---|---|---|
| 3,130,968 | A * | 4/1964 | De Feen | 482/132 |
| 4,398,713 | A * | 8/1983 | Ellis | 482/145 |
| 4,753,438 | A | 6/1988 | Paris | |
| 5,042,800 | A * | 8/1991 | Walter | 482/142 |
| 5,147,259 | A * | 9/1992 | Hutchins | 482/101 |
| 5,147,267 | A | 9/1992 | Kunewalder | |
| 5,221,246 | A * | 6/1993 | Torii | 482/144 |
| 5,306,220 | A * | 4/1994 | Kearney | 482/94 |
| 5,330,408 | A * | 7/1994 | Westmoreland, Jr. | 482/141 |
| 5,433,220 | A | 7/1995 | Kostich | |
| 5,551,934 | A | 9/1996 | Binette | |
| 5,681,250 | A | 10/1997 | Hoover et al. | |
| 5,913,759 | A | 6/1999 | Bostrom | |
| 5,935,050 | A | 8/1999 | Shahan | |
| 5,971,901 | A * | 10/1999 | Shaw | 482/142 |
| 5,971,902 | A | 10/1999 | Robertson et al. | |

(Continued)

FOREIGN PATENT DOCUMENTS

JP 2006-00238 A 1/2006

(Continued)

OTHER PUBLICATIONS

International Search Report and Written Opinion of the ISA (Korea) for International Application No. PCT/US2007/088190, dated May 23, 2008.

*Primary Examiner* — Loan Thanh
*Assistant Examiner* — Daniel Roland
(74) *Attorney, Agent, or Firm* — Albert Haegele; Leyendecker & Lemire, LLC

(57) ABSTRACT

The present invention includes an exercise apparatus adapted to exercise a user's gluteus muscles. The exercise apparatus and method of use allow the user to focus on and exercise gluteus muscles with specificity. Embodiments of the exercise apparatus include an upper body support, a foot support, and an exercise space. The exercise space is typically disposed substantially between an upper body support and a foot support, and permits substantial movement of a user's hips in both a forward direction and a rearward direction, substantially in or parallel to a user's sagittal plane. The exercise apparatus is adapted to load a user's gluteus muscles throughout a generally large range of gluteus muscle flexion and extension.

20 Claims, 5 Drawing Sheets

U.S. PATENT DOCUMENTS

| | | | | |
|---|---|---|---|---|
| 6,168,557 | B1 | 1/2001 | Liao | |
| 6,206,809 | B1 | 3/2001 | Habing et al. | |
| 6,220,994 | B1 | 4/2001 | Rich | |
| 6,280,367 | B1 | 8/2001 | Arsenault | |
| 6,299,569 | B1 | 10/2001 | Rich | |
| 6,319,180 | B1 | 11/2001 | Kallassy | |
| 6,398,699 | B1 * | 6/2002 | Yang | 482/142 |
| 6,468,188 | B1 | 10/2002 | Koenig | |
| 6,692,418 | B2 * | 2/2004 | Shahan | 482/144 |
| 6,955,635 | B2 | 10/2005 | Chelekis | |
| 7,115,081 | B2 * | 10/2006 | Stearns | 482/140 |
| 7,125,371 | B2 | 10/2006 | Henderson | |
| 7,128,701 | B1 * | 10/2006 | Ketcham | 482/142 |
| 7,367,928 | B2 * | 5/2008 | Storch | 482/141 |
| 7,488,281 | B2 * | 2/2009 | Weir et al. | 482/140 |
| 7,637,851 | B1 | 12/2009 | Lormil | |
| 7,717,837 | B2 | 5/2010 | Florczak | |
| 7,967,738 | B2 * | 6/2011 | Dauterive | 482/145 |
| 2002/0173412 | A1 | 11/2002 | Stearns | |
| 2003/0060347 | A1 | 3/2003 | Tang | |
| 2004/0053757 | A1 * | 3/2004 | Chung | 482/140 |
| 2004/0209750 | A1 | 10/2004 | Parmater | |
| 2005/0143233 | A1 | 6/2005 | Shifferaw | |
| 2009/0098988 | A1 | 4/2009 | Kennedy | |
| 2010/0179038 | A1 * | 7/2010 | Hahn | 482/142 |
| 2010/0204027 | A1 * | 8/2010 | Dauterive | 482/145 |

FOREIGN PATENT DOCUMENTS

| | | | |
|---|---|---|---|
| KR | 10-2002-0056991 | A | 7/2002 |

* cited by examiner 460
440
494
460
495
493
492
430
433
488
420

460
440
460
495
493
420
433
430
488

EXERCISE APPARATUS AND METHODS OF USE

This application is a Divisional application of, claims priority to, and incorporates by reference, U.S. patent application Ser. No. 12/299,167, which entered the US National stage on 31 Oct. 2008, from PCT application number PCT/US07/88190, filed 19 Dec. 2007, which claims priority to U.S. provisional Patent Application 60/870,828, filed 19 Dec. 2006; 60/870,839, filed 19 Dec. 2006; and 60/885,346 filed 17 Jan. 2007. The present application has the same inventor as the aforementioned applications.

FIELD OF THE INVENTION

The present invention is directed to devices adapted to exercise a user's gluteus muscles. The present invention is further directed to exercise routines that exercises the gluteus muscles.

BACKGROUND

Numerous exercise devices, assemblies, and routines claim to exercise and develop the gluteus muscles. However, these devices do not allow the user to work the gluteus muscles with specificity and through a wide range of motion. The lack of specificity results in other body structures, such as joints and other muscles, substantially sharing or experiencing a load that would preferably be placed on the gluteus muscles.

For instance, an exercise commonly known as a squat is known to work the gluteus muscles, quadriceps, hamstrings, and lower back, among other body structures. However, at one end of the range of motion of the squat, where a user's hips are positioned rearwardly, the user's knees are bent to a considerable degree and are highly loaded. In this bent and highly loaded position, a user's knees are subject to undesirable stress. The user's gluteus muscles are relatively highly, and therefore desirably, loaded in this position, where the gluteus muscles are generally extended. At the other end of the range of motion, where the user's hips are positioned approximately neutrally, the user's knees are relatively straight, and the user stands relatively upright. At this end of the range of motion, the load on the gluteus muscles is relatively low, which is undesirable for working or exercising the gluteus muscles. Squats are relatively highly technique dependent; they require good technique, which can be difficult or time consuming to develop, to avoid placing undesirable stress on the user's back or knees. Finally, not only do squats load the gluteus muscles highly unevenly across the range of motion exercised, that range of motion is itself limited undesirably. Squats do not extend or position the user's hips substantially forwardly in the sagittal plane, such that the gluteus muscles are adequately flexed.

Most devices, assemblies, and routines suffer the same or similar drawbacks to those exemplified by squats. They frequently do not load the gluteus muscles evenly or adequately across a broad range of motion. They thus only work the gluteus muscles in a limited range of motion relative to the full range of motion that is typically available to a person's hips and gluteus muscles.

Therefore, there exists in the prior art a dearth of apparatuses, assemblies, or routines, that involve a relatively small degree of knee angle change, and that focus load on gluteus muscles, while providing a relatively wide range of motion about the hip joint, in or parallel to the sagittal plane.

DETAILED DESCRIPTION

Figure 1:
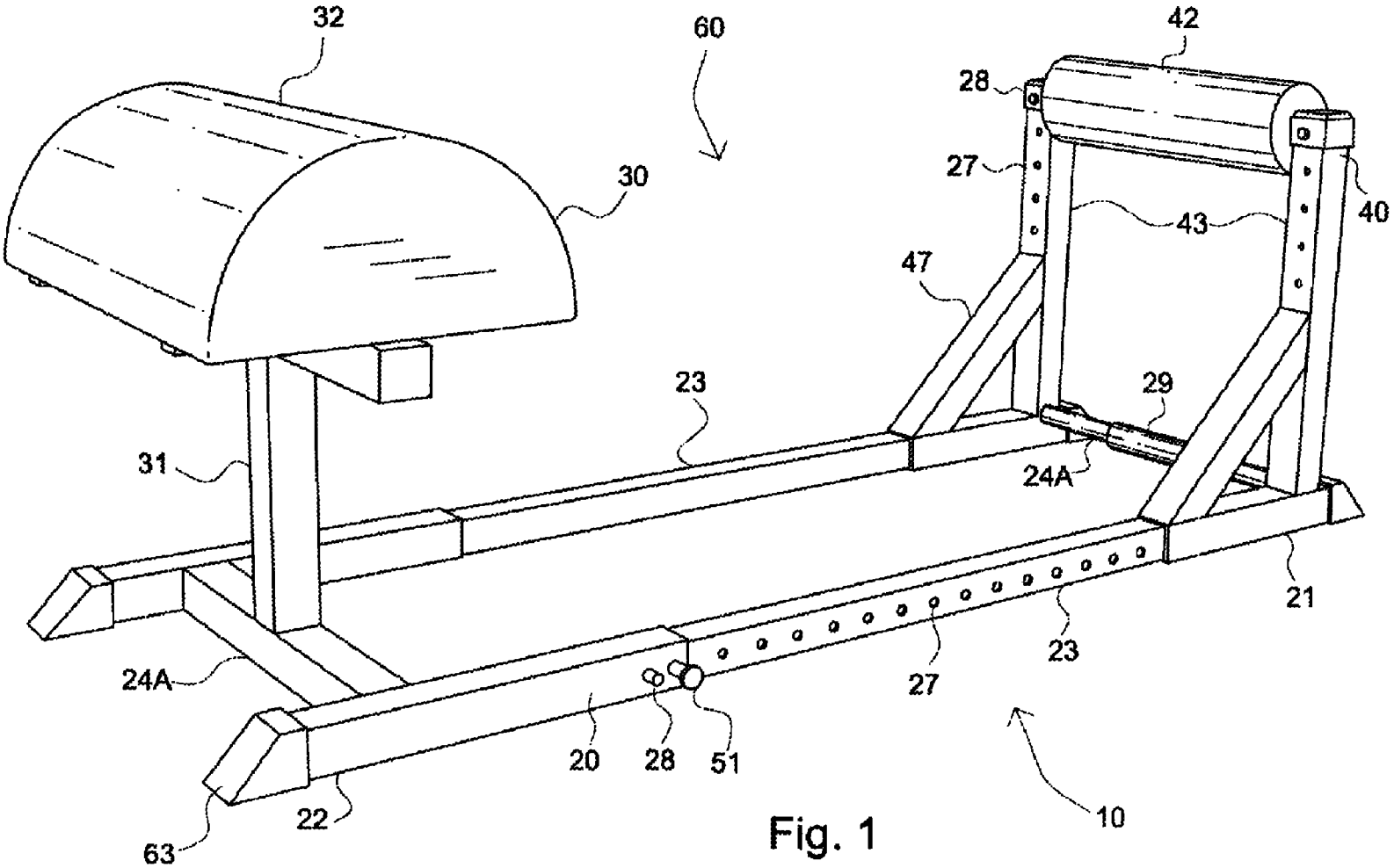
FIG. 1 is a perspective view of an exercise apparatus according to one embodiment of the present invention.

Embodiments of the present invention comprise an upper body support, a foot support, and an exercise space. The exercise space is disposed between an upper body support structure and a foot support structure, and is free of structures that would obstruct movement of a user's body or parts thereof in the exercise space. The exercise space thereby provides room for the user to move within the exercise space in a manner described in greater detail below.

Embodiments of the exercise space permit the user to flex his/her hips rearwardly, to positions where at least one of his/her femur angles is about 90°, with the user's upper back in contact with an upper body support and the user's foot of the leg whose femur angle is about 90°, in contact with a foot support. In these positions, the user's gluteus muscles are extended. The exercise space also permits a user to extend his/her hips forwardly, to positions where at least one of his/her femur angles is about 180°, with the user's upper back in contact with an upper body support, and the foot of the leg whose femur angle is about 180°, in contact with a foot support. In these positions, the user's gluteus muscles are flexed.

As used in this specification and the appended claims, all femur angles are relative to linear approximations of persons' spines, and refer to angles at the person's front, or ventral, sides. Moreover, all femur angles refer to the femur of a leg whose foot is in contact with, and supported or stabilized by, a foot support.

Embodiments of the exercise space provide sufficient room in a first direction, the first direction being approximately perpendicular to a line from an upper body support to a foot support, to permit a user to flex his/her hips such that at least one of the user's femur angles is approximately 90°. The exercise space provides sufficient room in a second direction, the second direction being opposite the first direction, to permit the user to extend his/her hips such that the user's femur angle is about 180°. The positions and angles described in this paragraph apply to positions where the user's upper body is supported or stabilized by an upper body support, and the foot of the leg whose femur angle is described, is positioned in contact with and supported or stabilized by a foot support.

Embodiments of the present invention further comprise a resistance apparatus adapted to apply loading force to a user's hips, in a rearward direction relative to the user. The loading forces have directions approximately perpendicular to linear approximations of users' spines. Some embodiments of loading forces are approximately perpendicular to straight lines between upper body supports and foot supports. The loading forces are approximately in or parallel to a user's sagittal plane. In some embodiments, gravitational pull of the earth on a user's body provides the loading force. In such embodiments, a ventral or front surface of a user's hips must be oriented facing upwardly while exercising, because the loading force provided by gravitational pull on the user's body is straight down.

In one embodiment, an apparatus comprises a base frame having a front end and a back end. The apparatus further comprises an upper body support having a top, wherein the upper body support is attached toward the back end of the base frame, and the top of the upper body support is at preferably at least 30 cm from the base frame or ground, more preferably at least 46 cm, and most preferably at least 61 cm from the base frame or ground. The apparatus further comprises a resistance apparatus and a foot support having a top, wherein the foot support is attached to the base frame toward the front end and the top of the foot support is preferably at least 15 cm from the base frame or ground, more preferably at least 30 cm, and most preferably at least 46 cm from the base frame or ground.

Some Embodiments comprise a resistance apparatus that couples to a hip restraint such as, but not limited to, a hip belt, the hip belt to be worn by the user around the user's hips or midsection during exercise. Embodiments of the resistance apparatus are functionally connected to the base frame.

An exercise space is sufficient in size to allow a user to lower his/her buttocks toward the base frame/ground, and to move his/her hips upwardly away from the base frame/ground against resistance created by the resistance apparatus while the user's upper back is on the upper body support and at least one of the user's feet is on the foot support.

An embodiment of an exercise apparatus has handles to assist a user to mount the exercise apparatus. In some embodiments, the handles are coupled to an upper body support member or an upper body support, extending toward a foot support outside an exercise space.

Embodiments of the upper body support and/or foot support are adjustable in an up and down direction to allow the user to adjust the apparatus to best suit the user's body type or size. In one embodiment, the top of the upper body support is higher than the top of the foot support. In some embodiments, a foot support is at least 15 cm higher.

Embodiments of a base frame are adjustable so that upper body and foot supports can be moved closer or further apart in order to accommodate different user heights. In some embodiments the upper body or foot supports can be adjustable in a horizontal direction so as to make the distance between the upper body support and foot support closer or further apart to accommodate different user heights. An embodiment of the resistance apparatus is designed to provide resistance as the user moves his/her hips upwardly away from the ground. In some embodiments, resistance is adjustable to provide greater or lesser resistance. In one embodiment, the exercise apparatus comprises resistance band pegs connected to the base frame between the upper body support and foot support and one or more resistance bands, including, but not limited to, Thera-Bands® or flex bands, functionally connected to the band pegs. As is known to persons of ordinary skill in the art, resistance bands typically comprise elastic material. In some embodiments, resistance bands may be exchanged with varying strength resistance bands to accommodate the user's exercise regime and level of strength.

In one embodiment, a resistance apparatus comprises a cable weight machine having a plate loading structure or weight stack structure, and a pulley system that is functionally connected to the base frame. In some embodiments, a pulley in the pulley system is disposed between the upper body and foot supports, in order to facilitate apply resistance, or loading force, to the user as the user moves their hips upwardly away from the ground. In some embodiments, the pulley system may be adjustable to allow the user to alter the direction and angle of resistance applied during the exercise motion.

An embodiment of the exercise apparatus is portable. Embodiments of the exercise apparatus comprise one or more wheels or a carrying handle. In one embodiment, the handle is connected to the front end of the base frame below the foot support, and the wheels are attached to the back end of the base frame so that the user can pick up the front end of the apparatus by the handle and easily move the apparatus to the desired location.

A method of exercising gluteus muscles of a user comprises the operations of: (i) providing an exercise apparatus, (ii) wearing a hip restraint around a user's hips, (iii) placing a user's upper back on the upper body support, (iv) resting at least one of a user's feet on a foot support, (v) lowering the user's buttocks downwardly toward the base frame or floor into the exercise space between the upper body support and foot support while flexing the user's hips and extending the user's gluteus muscles, followed by extending the hips upwardly away from the base frame against resistance created by the resistance apparatus.

In some embodiments, an exercise routine is performed with a relatively slow steady eccentric component, wherein a user's hips are lowered relatively slowly and steadily, and an explosive concentric component, wherein a user's hips are extended upwardly relatively quickly and powerfully. In some embodiments, an exercise routine comprises a relatively isometric hold at or near the top portion of hip movement. For a better understanding of the invention, its operating advantages and the specific objects attained by its uses, reference should be made to the attached drawings. It is understood that the attached drawings illustrate only certain embodiments of the invention and are therefore not to be considered limiting of its scope. The invention encompasses other equally effective embodiments as one skilled in the art will appreciate with the benefit of the detailed disclosure provided herein.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

Unless clearly indicated otherwise, the term "or" as used in this specification and the appended claims is not meant to be exclusive; rather the term is inclusive, meaning "either or both."

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The terms "couple" or "coupled," as used in this specification and the appended claims, refers to an indirect or direct connection between the identified elements, components, or objects. Often the manner of the coupling will be related specifically to the manner in which the two coupled elements interact.

As applicable, the terms "about," "generally," or "approximately," as used herein, unless otherwise indicated, means a margin of +/−20%. Also, as applicable, the term "substantially" as used herein unless otherwise indicated means a margin of +−10%. It is to be appreciated that not all uses of the above terms are quantifiable such that the referenced ranges can be applied.

The terms "relative to a user's spine," or "angle relative to a line parallel to a user's spine," or "parallel to a user's spine," or "relative to a person's spine," as used in this specification and the appended claims, refers to alignment relative to a linear approximation of an exercise apparatus user's spine. It is apparent to a person of ordinary skill in the art, that most peoples' spines are curvilinear. However, for the purposes of this application, a linear approximation of a person's spine is a straight line approximately through the person's cervical vertebrae and approximately through the person's coccyx.

The term "femur angle" as used in this specification and the appended claims, refers to an angle of a line through a longitudinal axis of a person's femur, relative to a line parallel to a user's spine. As used in this specification and the appended claims, all femur angles refers to angles at the front side, also known as the ventral side, of the person. Moreover, all femur angles refer to a femur of a leg whose foot is in contact with a foot support. Where a person's femur angle is 180°, a line through the longitudinal axis of the person's femur is parallel to a linear approximation of the person's spine. Similarly, where a person's femur angle is 90°, a straight line through a longitudinal axis of the person's femur is at a 90° angle relative to a line parallel to a linear approximation of the person's spine.

The term "glute" or "glutes," as used in this specification and the appended claims, refers to a group of muscles comprising the gluteus medius, gluteus maximus, and gluteus minimus. Gluteus maximus, medius and minimus, or "glutes," are three muscles of the buttocks and hips.

The terms "substantially moving," "deflecting," or "substantially moving or deflecting," as used in this specification and the appended claims, refers to movement or deflection of a substantially rigid structure associated with overloading the structure. Thus where an upper body support or foot support substantially moves or deflects in response to being placed under load, weight, or force, the substantially rigid component of the structure bends, yields, or deforms undesirably in response to the load weight. All structures move, deflect, or deform slightly in response to normal load or use; substantially moving or deflecting does not refer to this normal, nominal, and minor movement or deflection.

The terms "substantially between the upper body support and the foot support," or "substantially between an upper body support and a foot support" as used in this specification and the appended claims, refers to points between a plane that intersects a center of mass of the upper body support and a different plane that intersects a center of mass of the foot support, both of the aforementioned planes being substantially perpendicular to a straight line from the center of mass of the upper body support to the center if mass of the foot support. The terms "substantially between the upper body support and the foot support," or "substantially between an upper body support and a foot support" as used in this specification and the appended claims, refers to a three dimensional space in which an exercise space resides.

The term "exercise space" as used in this specification and the appended claims, refers to a three dimensional space in which an exercise apparatus user moves or can move or change position without being obstructed by a component of the exercise apparatus, or by a floor, ground, or other surface on which the exercise apparatus resides. Exercise spaces in embodiments of the present invention are disposed between an upper body support and a foot support, and are intersected by a straight line from the upper body support to the foot support. Typically, when a user performs an exercise using an embodiment of the present invention, the user's hips, lower abdomen and back, and upper legs and knees, are the body parts of the user that do most moving or changing position in an exercise space. In contrast, a user's upper back, neck, and head typically remain proximate an upper body support, and do not substantially move or change position within an exercise space of embodiments of the present invention. Similarly, at least one of a user's feet typically remains proximate a foot support, and does not substantially move or change position within an exercise space of an embodiment of the present invention. An exercise apparatus without adequate exercise space prevents a user from moving about in the exercise space with sufficient range to flex and extend the user's hips. Prior art exercise devices are deficient in providing sufficient exercise spaces for users to adequately flex their hips by achieving a femur angle of 90° or less while, having their knees bent at an angle of about 90°.

The terms "substantially empty of exercise apparatus components," as used in this specification and the appended claims, refers to a characteristic of an exercise space, wherein no component of the exercise apparatus, other than part of a resistance apparatus adapted to apply a loading force to a user of the exercise apparatus, intrudes into the exercise space. Resistance apparatus parts may, by necessity, intrude into the exercise space in order to apply resistance force or loading force to a user. In contrast, other exercise apparatus components would likely obstruct a user's movement within the exercise space, were they to intrude into the exercise space.

The terms "up," "upward" and "upwardly," as used in this specification and the appended claims, refers being oriented within 45° of straight up, away from the center of the earth.

The terms "down," "downward" and "downwardly," as used in this specification and the appended claims, refers being oriented within 45° of straight down, toward the center of the earth. For the purposes of this application, the direction of the gravitational pull of the earth on a person or thing on earth is straight down, toward the center of the earth.

A First Embodiment Exercise Apparatus

Referring to FIG. 1, a first embodiment exercise apparatus 10 comprises a base frame 20 having a front end 21 and back end 22, an upper body support 30 having a top 32; a foot support 40 also having a top 42. The upper body support 30 and foot support 40 are both coupled to the base frame 20. The upper body support 30 is attached toward the back end 22 of the base frame 20 and the foot support 40 is connected toward the front end 21 of the base frame 20. The upper body support 30 and foot support 40 in the first embodiment are preferably at least 91 cm apart, more preferably at least 105 cm apart; and most preferably at least 130 cm apart, thereby providing an exercise space 60 sufficient to allow the user to lower their buttocks toward the base frame 20 or floor followed by moving the hips upwardly away from the base frame 20 or floor against resistance.

Base Frame Embodiments

Figure 2:
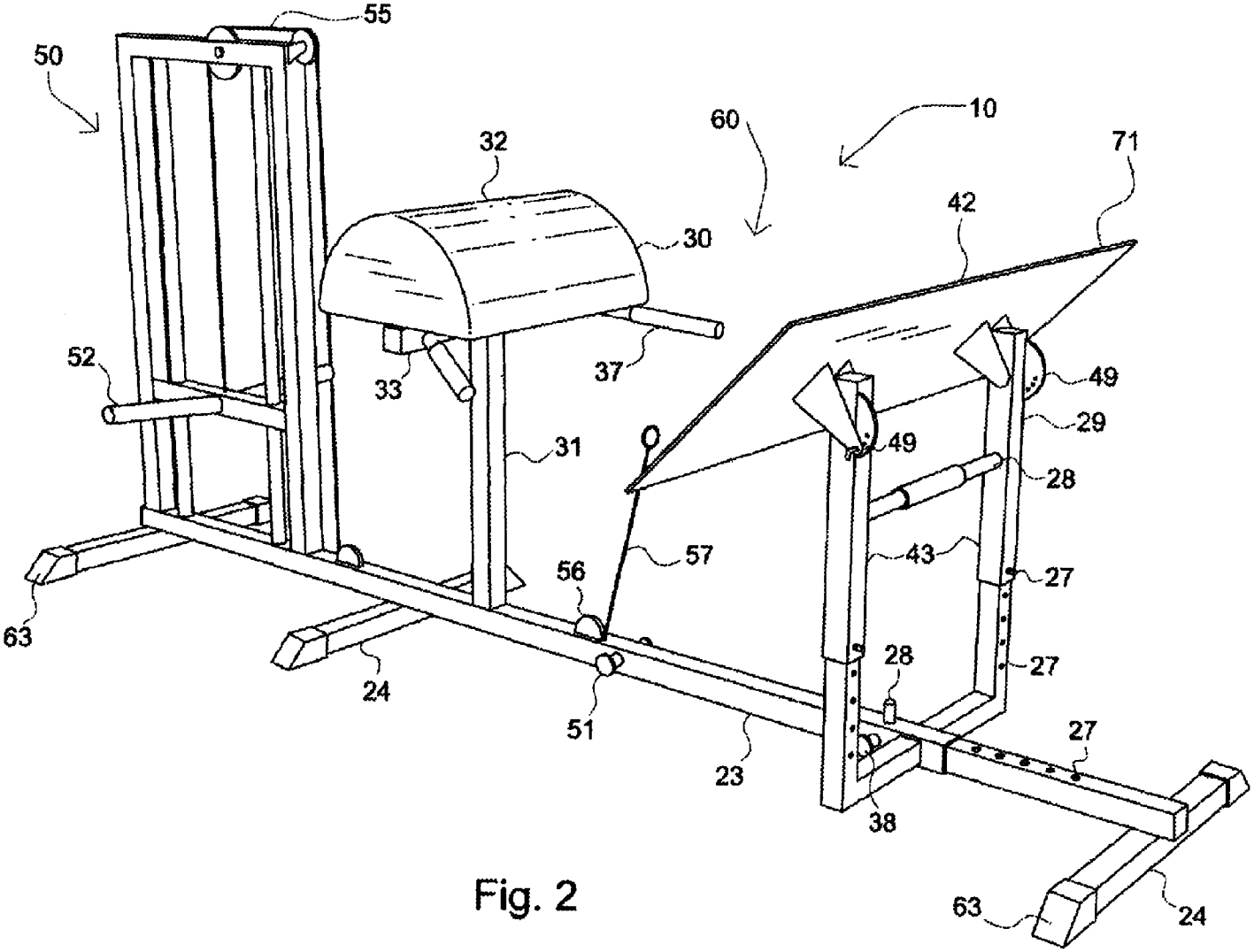
FIG. 2 is a perspective view of an exercise apparatus according to one embodiment of the present invention.
Figure 3:
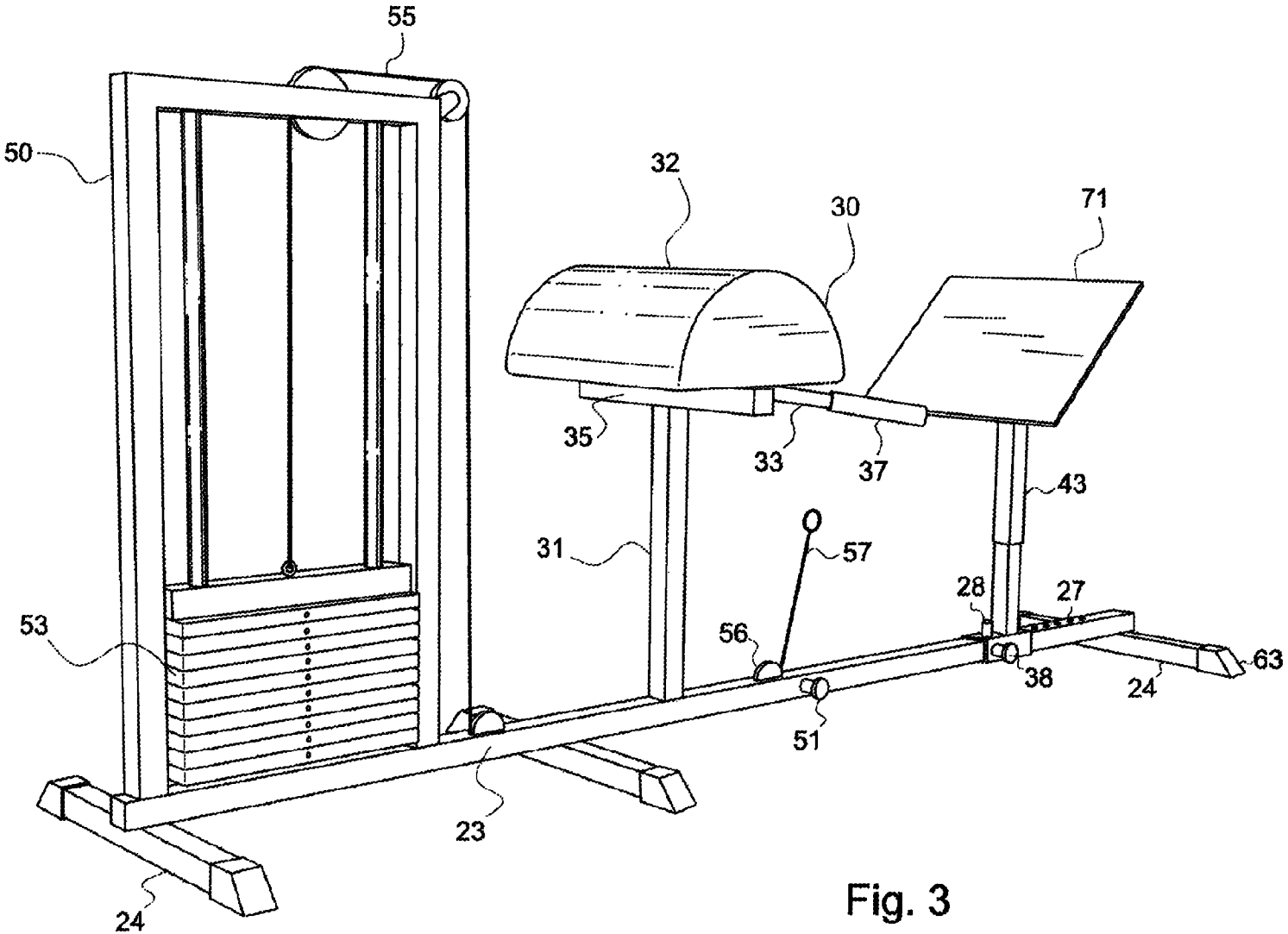
FIG. 3 is a perspective view of an exercise apparatus according to one embodiment of the present invention.

As shown in FIGS. 1-3, embodiments of a base frame 20 typically comprise at least one elongated rail 23 and at least one cross member 24 or rail joining member 24A to provide stability to the apparatus 10. As shown in FIG. 1, the base frame 20 comprises two elongated rails 23 and at least two rail joining members 24A to provide stability and to keep the elongated rails 23 from moving apart during use. The rail joining members 24A are typically, but not necessarily, proximate the front end 21 and back end 22 of the base frame 20. In embodiments illustrated in FIGS. 2-3, the base frame 20 comprises one elongated rail 23 with three transverse frame members 24, and in the embodiments shown, three cross members 24, to provide stability.

The base frame 20 is made of sufficiently strong material, such as rectangular or circular hollow section steel, to withstand the stresses and safety demands of use for exercises that work the glutes. In some embodiments, cross members 24 and rail joining member 24A form a rigid and stable base with the elongated rail(s) 23.

Embodiments of a base frame 20 are collapsible to allow a user to adjust the base frame 20 to accommodate the user's height. The base frame 20 is collapsible between 30 cm and 46 cm of the length of the exercise apparatus 10. A variation of a collapsible base frame 20 provides adjustment holes 27 and a locking apparatus 28. In one embodiment, there are at least eight adjustment holes 27 at two inch increments for a total adjustment of sixteen inches.

The base frame 20 is preferably at least 122 cm in length and more preferably at least 152 cm in length. A width of the base frame 20 is preferably at least 46 cm, and more preferably between 61 cm and 91 cm wide in order to provide stability. In one variation, the base frame 20 is over 274 cm long (including a resistance apparatus 50) and over 61 cm wide. In another variation, the base frame 20 is between 152 cm and 183 cm long, and the width of the base frame is within 15 cm of 61 cm.

Embodiments of the exercise apparatus 10 are portable with wheels and a carrying handle 29. The carrying handle 29 can be connected to the front end of the base frame 20 below the foot support 40 and the wheels are attached to the backend 22 of the base frame 20 so that the user can pick up the front end 21 of the apparatus 10 by the handle 29 and easily move the apparatus to the desired location. The handle 29 also functions as a cross member 24 or rail joining member 24A, thereby providing stability to the apparatus while also serving as a handle 29. Variations of the handle 29 have a covering, such as a rubber hand grip, to provide a comfortable grip while moving the apparatus.

In some embodiments, height adjustable feet (not shown) of the type commonly used on furniture are disposed at various locations on the base frame 20. Height adjustable feet are of a type commonly used on furniture. Some embodiments of height adjustable feet facilitate to stabilize the exercise apparatus on an uneven surface. Rubber feet may also be used. For example, rubber feet 63 may be placed at the ends of the transverse frame members 24 and/or at the ends of the elongated rails 23.

Upper Body Support Embodiments

Embodiments of an upper body support 30 are sufficiently strong and rigid to support a mass of at least 80 kilograms at a height of at least 25 cm above a floor or other surface on which the exercise apparatus rests. At least this degree of strength and rigidity is required to support a user's upper back or upper body during use of embodiments of the exercise apparatus 10.

The upper body support 30 is sufficiently large and shaped to comfortably support a user's upper back while exercising. The upper body support 30 is adapted to relatively comfortably support an upper body of a human user of average sensitivity, with a force of at least 178 newtons being applied to the upper body support through the upper body of the human user. In addition, the upper body support is padded, the padding comprising open or closed cell foam or similar material.

Embodiments of upper body supports 30, illustrated in FIGS. 1-3, comprise curvilinear surfaces, on which a user's upper body or back rests during use of an exercise apparatus. The upper body supports have a curved surface facing approximately toward a foot support 40.

The top of the upper body support 30 is preferably at least 25 cm high as measured from the base frame 20 or floor, more preferably at least 46 cm high as measured from the base frame or floor, and most preferably at least 61 cm high as measured from the base frame 20 or floor. In one variation, the top of the upper body support 30 is between 61 cm and 122 cm from the base frame 20 or floor.

Typically, but not necessarily, the upper body support 30 comprises at least one upper body strut 31, which attaches to the base frame 20. The upper body strut 31 is adjustable in an up and down direction to allow the user to customize the exercise apparatus The range of adjustment is typically, but not necessarily, between 30 cm to 122 cm in height.

Embodiments of the exercise apparatus 10 have mounting handles 33 to assist the user to mount the exercise apparatus 10. Mounting handles 33 are typically, but not necessarily connected to the upper body support 30 or the upper body strut 31 itself, extending toward the foot support 40 outside the exercise space 60.

Foot Support Embodiments

Embodiments of a foot support 40 are sufficiently strong and rigid to support a mass of at least 80 kilograms at a height of at least 25 cm above a floor or other surface on which an exercise apparatus rests. At least this degree of strength and rigidity is required to support a user's foot or feet during use of embodiments of the exercise apparatus 10.

The foot support 40 is sufficiently large and shaped to comfortably support a user's feet while exercising. The foot support is adapted to comfortably support at least one foot of a human user of average sensitivity, with a force of at least 135 newtons being applied to the foot support through the foot or feet of the human user.

As shown in FIG. 1, the foot support is padded. An embodiment of a padded foot support 40 is upholstered with cushioning material such as open or closed cell foam, a foam mattress, or foam material such as, polyurethane. Embodiments of a foot support typically comprise one or more foot support struts 43 that connect to the base frame 20.

The foot support in certain embodiments also comprises one or more stability struts 47 that attach to the foot struts 43 and base frame 20 providing additional stability, as shown in FIG. 1.

As shown in FIGS. 2-3, the foot support 40 is not padded and is in the form of a plate 45. FIG. 2 illustrates an embodiment comprising a foot plate angle that is readily adjustable, the foot plate angle being the angle between a straight line between the center of the top of the upper body support 32 and the center of the top of the foot support 40, and a plane of the substantially planar surface of the foot plate. The foot plate 71 is pivotally connected to the foot support struts with an angle adjuster 49, the foot angle 71 being adjustable to between seventy-five and one hundred eighty degrees, at fifteen degree increments.

The top of the foot support 40 is preferably at least 15 cm high as measured from the base frame 20 or floor, more preferably at least 30 cm, and most preferably at least 61 cm high. In one embodiment, the top of the foot support 40 is between 30 cm and 122 cm high.

Embodiments of a foot support 40 and/or upper body support 30 are adjustable in a horizontal direction as shown in FIGS. 2-3. As shown in FIGS. 2-3, the foot support is adjustable by sliding along the elongated rail 23, preferably providing an exercise space of between 96 cm and 148 cm. Variations include an increment pin and threaded rod with knob lock the foot support in position and provide stability. In one embodiment, a foot support is horizontally adjustable having a horizontal member which connects to the foot support strut.

Embodiments of the upper body support 30 and/or foot support 40 are also adjustable in an up and down direction to allow the user to adjust the apparatus 10 to best suit the user's body size or type. In one embodiment, the top of the upper body support 30 is higher than the top of the foot support 40, preferably at least 15 cm higher, more preferably 15 cm to 30 cm higher. For example, in one embodiment the upper body support 30 is 61 cm high and the foot support is 46 cm high.

Resistance Apparatus Embodiments

An embodiment of the resistance apparatus 50 is adapted to provide resistance as the user moves his/her hips upwardly away from the ground. The resistance is adjustable to provide greater resistance as the user becomes stronger. The resistance apparatus comprises resistance band pegs 51, or resistance hooks, connected to the base frame between the upper body support and foot support. Variations comprise one or more resistance bands, or flex bands, functionally connected to the band pegs 51, and functionally connected to a hip restraint to be worn by the user. Suitable hip restraints include, but are not limited to, a padded hip bar, a hip belt, or a hip strap. Resistance bands may be exchanged with varying strength resistance bands to accommodate the user's exercise regime and level of strength.

In one embodiment, the resistance apparatus comprises a cable weight machine having a plate loading structure (see FIG. 2, plate loading structure 52) or weight stacking structure (see FIG. 3, weight stacking structure 53). The resistance apparatus includes a pulley system comprising a primary pulley 56 that is functionally connected to the base frame between the upper body support and the foot support, which connects to a hip restraint (not shown), such as a hip belt worn by the user, to apply resistance to the user as the user moves his/her hips upwardly away from the ground. In some variations, the primary pulley 56 may be adjustable to allow the user to alter the direction and angle of resistance applied during the exercise motion. The primary pulley provides a resistance point, the resistance point being a point toward which a loading force provided by the resistance apparatus is directed.

A primary pulley 56 is disposed between the upper body support and foot support. The primary pulley 56 is adjustable in a front to back direction so that when the upper body support and foot support are moved closer together the pulley point is adjusted to take in to account the adjustments made and applies resistance in an up and down direction when the user reaches the bottom position of the movement. This is typically about 30 cm in front of the upper body support.

Resistance band pegs 51 and/or the primary pulley is disposed between the upper body support 30 and foot support 40, preferably closer to the upper body support than the foot support, and more preferably within 25 cm to 41 cm of the upper body support.

In some embodiments, the resistance apparatus comprises free weights that can be functionally connected to the hip restraint to provide resistance as the user moves his/her hips upwardly away from the floor or base frame.

In other embodiments, loading force is provided by a resistance apparatus commonly known to persons of ordinary skill in the art, including, but not limited to, a plate loading structure, a weight stack structure, a pneumatic resistance device, or a deforming bow device such as a Bowflex® bow.

Exercise Space Embodiments

Embodiments of the exercise apparatus comprise an exercise space 60, as illustrated in FIGS. 1-2. The exercise space is disposed between an upper body support 30 and foot support, and is adapted to allow the user to exercise throughout a substantially full range of hip motion in the user's sagittal plane, the full range of hip motion comprising hip flexion and hip extension. So adapted, the exercise space permits the user to flex the user's hips and lower his\her buttocks, with the user's upper back supported on the upper body support and the user's feet supported on the foot support, until the user's femur angle is about 90°.

The exercise space also allows the user to extend his/her hips upwardly against resistance created by the resistance apparatus 50 to exercising the glutes. The user's hip flexion and extension so described are unobstructed within embodiments of the exercise space. Typically, the upper body support 30 and foot support 40 are spaced so that the user's knee joints are at around ninety degrees at the top of the exercise, i.e., when the user's hips are fully extended upwardly away from the floor or base frame 20.

The top of the upper body support 30 and foot support 40 are preferably at least one foot, more preferably at least one foot and one half; and most preferably at least 61 cm from the base frame 20 or ground. The upper body support 30 and foot support 40 are preferably at least 91 cm apart, more preferably at least 107 cm apart, and most preferably at least 122 cm apart, being adjustable to 91 cm apart. The distance between the upper body support 30 and foot support 40 is between 91 cm and 152 cm. The base frame 20 is preferably adjustable so that the upper body support 30 and foot support 40 can be moved closer or further apart in order to accommodate different user heights and provide sufficient exercise space 60.

In some embodiments the upper body support 30 or foot support 40 is adjustable in a horizontal direction so as to make the distance between the upper body support and foot support closer or further apart, to accommodate different user heights.

In some embodiments, the exercise space is adjustable, for example, from about 91 cm to 96 cm for a 152 cm tall person to about 127 cm to 147 cm for a person over 182 cm tall. The exercise space 60 may be adjustable, for example, by means of an adjustable base frame 20 (see FIG. 1) or an adjustable upper body support 30 or foot support 40 (see FIGS. 2-3).

In one embodiment, the upper body support 30 and/or foot support 40 are adjustable in an upward or downward direction, preferably by 10 or more cm, for example 15 cm to 30 cm, and more preferably by at least 20 cm, allowing the user to customize the exercise apparatus to the user's body type and to customize the exercise space 60.

As illustrated in FIG. 1, a first embodiment exercise apparatus 10 has a base frame 20 comprising two elongated rails 23 and two rail joining members 24A, one at the front end and the other at the back end. The base frame comprises elongated rails 23 with rubber feet at the ends and a rail joining member 24A at the front end also serves as a handle 29 having a hand grip thereon. The exercise apparatus 10 further comprises an upper body support 30 and foot support 40. The foot support 40 comprises a foot pad having a 12 cm diameter and two vertical foot struts 43 and two stability struts 47 attached to the foot struts 43 and base frame 20, the top of each vertical foot strut 43 being 57.2 cm from the ground. The foot support is adjustably connected to the base frame 20 in a horizontal and up and down direction. The width of the base frame being 56.5 cm and the length when fully extended being 168 cm long, with a 41 cm collapsible range comprising eight holes at 5.1 cm increments so that when collapsed the apparatus is about 128 cm in length.

The foot support is adjustable in an up and down direction having five holes at 5.1 cm increments. The upper body support 30 comprises a D shaped pad being about 56 cm wide, and a "T" shaped vertical upper body strut.

The exercise apparatus further has a resistance apparatus 50 comprising band pegs 51 located between the upper body support and foot support and resistance bands to provide resistance while extending the hips upwardly away from the base frame.

Other Exercise Apparatus Embodiments

In one embodiment, the exercise apparatus 20 is able to accommodate taller athletes. The apparatus 20 has an exercise space that adjusts in length from about 96 cm (for a 152 cm tall user) to about 147 cm (for a 203 cm user). Some embodiments of the apparatus 20 are about 61 cm to 76 cm wide. As shown in FIG. 2, the base frame 20 comprises one elongated rail 23 and three cross members 24 providing stability to the apparatus 10.

The upper body support 30 comprise a D-shaped pad attached to a 2.5 cm shaped vertical upper body strut. The upper body support further comprises mounting handles 33, which connect to the upper body support strut 35, the mounting handles having handle grips 37.

Embodiments of the foot support comprise a plate made of 3/16 inch diamond plate steel. The foot plate 71 is about 122 cm by 46 cm in an athletic embodiment exercise apparatus (FIG. 2) and about 61 cm by 41 cm in a commercial embodiment. The angle of the foot plate 71 is also adjustable, preferably from seventy-five to one hundred eighty degrees, in fifteen degree increments (FIGS. 2-3). The foot support 40 may also be horizontally adjustable by sliding along the elongated rail 23 and having ten positions, which provide an exercise space of between 96 cm to 147 cm. An increment pin 28 and threaded rod with knob 48 lock the foot support in position and provide stability. The foot support 40 being further adjustable in an up and down direction along the foot support struts 43, having five holes 27 at 5.1 cm increments and having a handle 29 to facilitate the foot support 43 adjustments.

The overall length of an embodiment of the exercise apparatus 10 is 288 cm, including the resistance apparatus, which has a pulley weight system 55, coupled to either a plate loading structure (FIG. 2) or weight stack structure (FIG. 3). The pulley weight system 55 is about 122 cm tall and about 61 cm long from front to back along the elongated rail 23. The pulley weight system 55, having a restraint attachment 57 between upper body support 30 and foot support 40, which is attachable to the hip restraint such as a hip belt, to be worn by the user during exercise. Embodiments that comprise a restraint apparatus typically comprise a structure, such as a waist belt, to transfer loading force to a user's body.

A Fourth Embodiment Exercise Apparatus

Figures 4A, 4B:
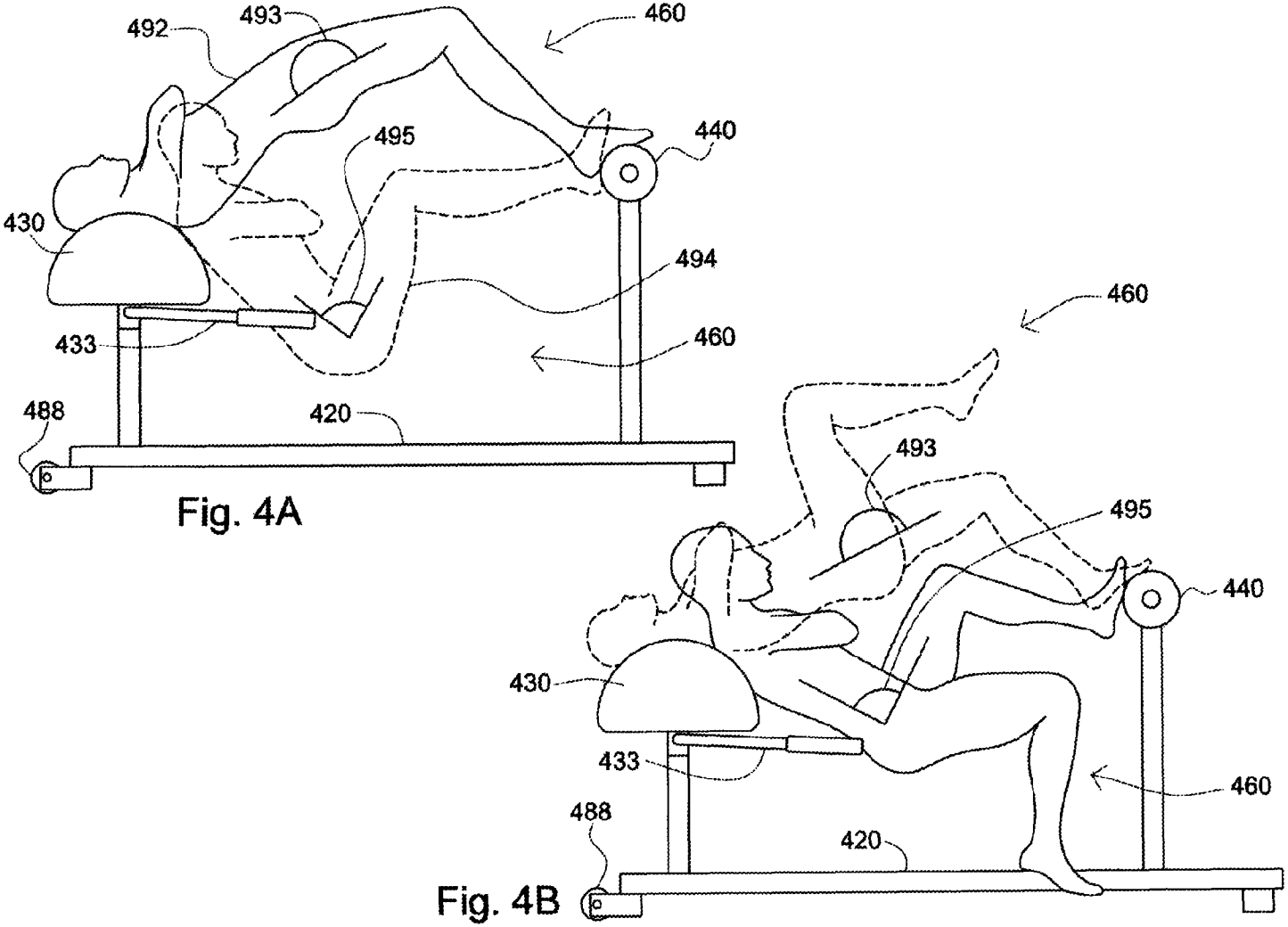
FIG. 4A is a side view of a person on an exercise apparatus according to one embodiment of the present invention.
FIG. 4B is a side view of a person on an exercise apparatus according to one embodiment of the present invention.

A fourth embodiment exercise apparatus is illustrated in FIGS. 4A and 4B. The exercise apparatus comprises an upper body support 430, a foot support 440, a base frame 420, and mounting handles 433. The exercise apparatus further comprises one or more wheels 488 adapted to facilitate moving the exercise apparatus.

FIG. 4A illustrates a user in two different positions on the exercise apparatus, with both feet on the foot support 440. The user is in a hip extended position 492 where his/her hip extended femur angle 493 is greater than 180°. In the hip extended position, the user's glutes are generally flexed. The user is in a hip flexed position 494 where his/her hip flexed femur angle 495 is less than 90°. In the hip flexed position, the glutes are generally extended.

In both the hip extended position 492 and the hip flexed position 494 illustrated in FIG. 4A, the user's hips, knees, and a substantial portion of the user's torso, are disposed in an exercise space 460, the exercise space itself being disposed substantially between the upper body support 430 and the foot support 440, and above the base frame 420. The user is able to perform an exercise routine, wherein the user extends his/her hips to a hip extended femur angle 493 of greater than 180°, and flexes his/her hips to a hip flexed femur angle 495 of less than 90°, without having hip extension or flexion obstructed by any part of the exercise apparatus, or the floor, ground, or other surface on which the exercise apparatus sets.

A user's act of moving from the hip flexed position 494 to the hip extended position 492 lifts the user's hips in a direction approximately opposite the force of gravity. Gravitational pull of the earth on the user's body thus provides a loading force, the loading force being approximately consistent through a broad range of motion of the user's hips illustrated in FIG. 4A. That range of motion is substantially in the user's sagittal plane. Similarly, the glutes are approximately consistently loaded through a broad range of motion. The even loading of the glutes through a large range of motion, illustrated in FIG. 4A, is heretofore unknown in the exercise arts, and is not possible with prior art equipment.

Some embodiments of the present invention, with the same approximate structure of the fourth embodiment exercise apparatus, but in addition comprising a resistance apparatus, employ the resistance apparatus to impede hip extension within the exercise space. Embodiments of the resistance apparatus are adapted to apply a loading force in a direction approximately opposite the direction of a user's hip motion when the user extends his/her hips from hip flexed position to a hip extended position.

FIG. 4B illustrates a user in two different positions on the exercise apparatus, with only the user's left foot on the foot support 440. The user's hip extended femur angle 493 in this figure is about 180°, and the hip flexed femur angle 495 is about 90°. Here, only the user's left femur forms a femur angle, as the term is used in this application, because only the left foot is supported on the foot support. The glutes on the left side of the user's hips are therefore preferentially loaded and exercised by the exercise illustrated in FIG. 4B. The user's left hamstrings are also loaded and exercised.

A Method of Using an Exercise Apparatus

Figure 5:
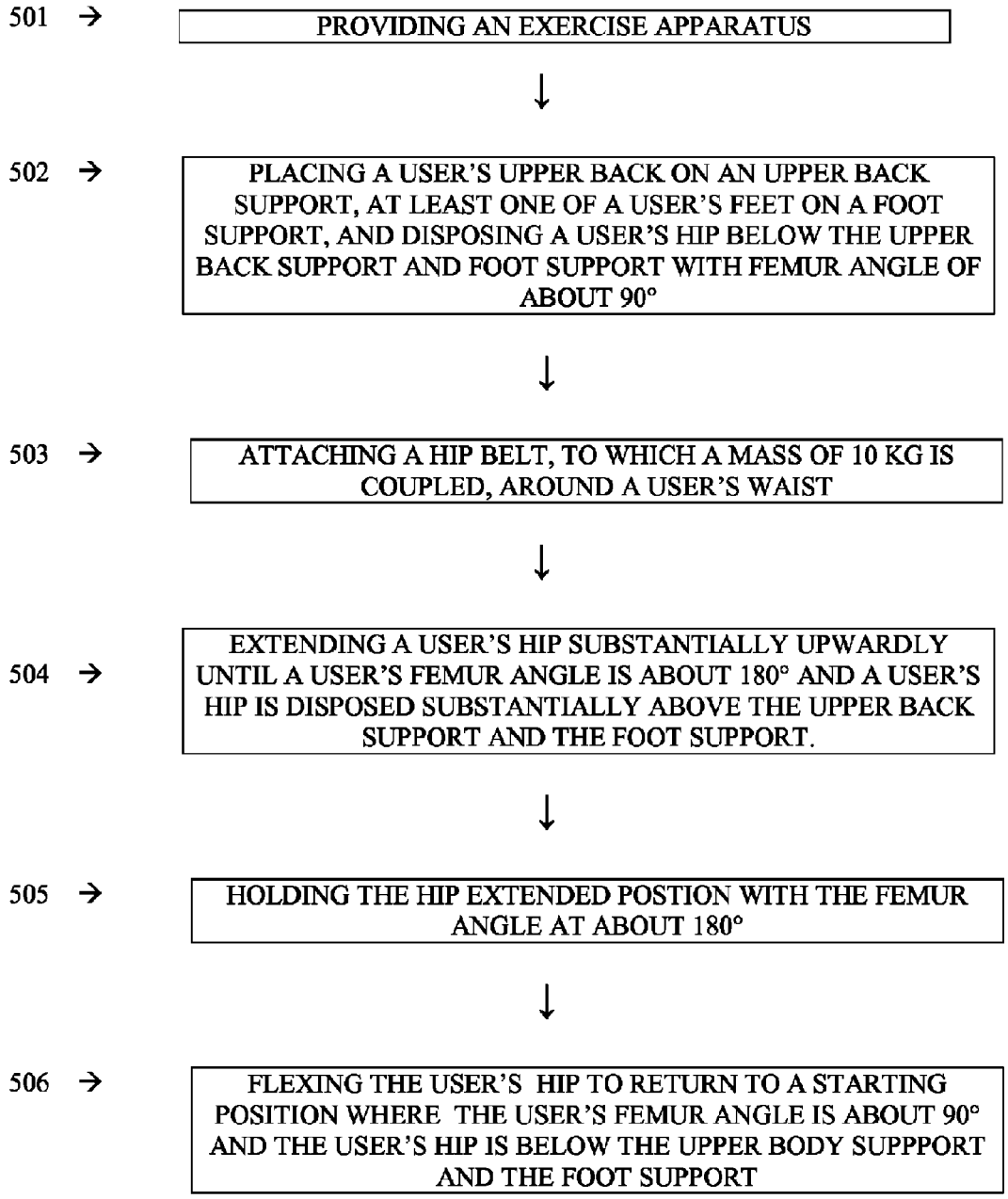
FIG. 5 is a flow chart illustrating a method of using an exercise apparatus according to one embodiment of the present invention.

A method of using an exercise apparatus according to an embodiment of the present invention is illustrated in FIG. 5. The first operation 501 of the method comprises providing the exercise apparatus of FIG. 4A.

The second operation 502 of the method comprises a user placing his/her upper back against the upper body support of the exercise apparatus and both of his/her feet on the foot support, with the user's femur angle at about 90°, and the user's hips below a straight between the upper body support and foot support and therefore relatively low in the exercise space. As is apparent to one of ordinary skill in the art, this position is only made possible be an exercise space that extends substantially below a straight line between the upper body support and the foot support. So disposed, all of a user's weight is borne by the upper body support and the foot support in combination; similarly some of the user's weight is suspended between the upper body support and the foot support. In other embodiments of methods of using the exercise apparatus of FIG. 4, a user places only one foot on the foot support, and therefore preferentially exercises the glutes and hamstrings on one side of the user's body. In some embodiments, where a user places only one foot on the foot support, the user is free to use the other foot to help support his body in some positions.

The third operation 503 of the method comprises the user attaching a hip belt, to which is coupled a mass of 10 kg, around the user's waist or hips. Other embodiments use no apparatus to provide additional loading force beyond that provided by the gravitational pull of the earth on the user's body. Still other embodiments use resistance apparatuses comprising structures such as, but not limited to, plate loading structures, weight stack structures, elastic members, deflecting bow structures such as Bowflex® bows, or pneumatic resistance structures. In some embodiments, a user places a weight such as a plate, dumbbell, or barbell in his/her lap, to provide additional loading force.

The fourth operation 504 of the method comprises the user extending his/her hips upwardly, lifting the 10 kg attached to the weight belt in the process, until his/her femur angle is at about 180°, and the user's hips are above a straight line between the upper body support and the foot support. The user's glutes are approximately consistently loaded throughout the range of glute flexion and extension of this exercise. As is apparent to a person of ordinary skill in the art, moving from a position with a femur angle of about 90° to a femur angle of about 180° entails a broad range of glute flexion. In some embodiments, a user performs the fourth operation with an explosive burst of effort, extending his/her hips upwardly relatively quickly.

The fifth operation 505 of the method comprises the user briefly holding the position achieved at the end of the fourth operation. Typically, the user holds this position for about a second. In some embodiments the user holds this position for three or more seconds. In other embodiments, the user does not hold this position for even a second.

The sixth operation 606 of the method comprises the user flexing his/her hips to return to a starting position, where his/her femur angle is about 90°, and his/her hips are disposed below a straight line from the upper body support to the foot support. In some embodiments, a user performs this operation relatively slowly compared to the fourth operation of hip extension. In some embodiments, a user repeats the hip extending and hip flexing motion of the method numerous times.

Other Embodiments of Methods of Using an Exercise Apparatus

In some methods of using exercise apparatuses, users use embodiments of exercises apparatuses illustrated in FIGS. 1-3.

In one embodiment, the method comprises the operations of: (i) wearing a hip restraint 56 around the user's hip area, (ii) placing the user's upper back on the upper body support 30, (iii) resting at least one of foot on the foot support 40, (iv) lowering the user's buttocks downwardly toward the base frame or floor into the exercise space 60 between the upper body support 30 and foot support 40 followed by extending the hips upwardly away from the base frame against resistance created by the resistance apparatus 50. The exercise is repeated according to the user's exercise regime.

Preferably the exercise is performed with a slow steady eccentric component, an explosive concentric component, and a brief isometric hold at the top portion of the movement, e.g., one second. In one optional embodiment, the hip thrust exercise described can be performed without the exercise apparatus 10, or with the exercise apparatus 10 but without the resistance apparatus attached to the user.

In this embodiment, the method comprises the operations of (i) the user holding free weights, such as dumbbells, or optionally wearing a weighted hip belt around the user's hip area (ii) placing the user's upper back on the upper body support 30 (iii) placing at least one foot on the foot support 40, (iv) lowering the user's buttocks downwardly in the exercise space 60, toward the base frame or floor, and, (v) lifting and extending the user's hips upwardly away from the base frame or ground, the lifting being against resistance created by the free weight or weighted hip belt. The exercise is repeated according to the user's exercise regime.

I claim:

1. A method of performing an exercise routine, comprising:

providing an exercise apparatus, the exercise apparatus comprising an upper body support, the upper body support being adapted to support a mass of at least 80 kilograms at a height of at least 25 cm above a surface on which the exercise apparatus rests;

placing an upper back of a user against the upper body support;

supporting a substantial entirety of a body weight of the user with the upper back of the user and at least one foot of the user;

assuming a hip flexed position, the hip flexed position comprising;

the upper back of the user being against the upper body support;

the substantial entirety of the body weight being supported by the upper back of the user and the at least one foot of the user;

a hip of a user being disposed below the upper body support;

a femur angle of the user being at about 90';

at least one of a user's knees being bent at an angle of about 90';

extending the hip of the user until the user achieves a hip extended position, the hip extended position comprising;

the upper back of the user being against the upper body support;

the substantial entirety of the body weight being supported by the upper back of the user and the at least one foot of the user;

the femur angle of the user being at about an angle of 180°; and the knee of the user remaining bent at an angle of about 90°.

2. The method of performing an exercise routine of claim 1, further comprising returning to the hip flexed position.

3. The method of performing an exercise routine of claim 1, further comprising providing a resistance apparatus, the resistance apparatus being adapted to apply a loading force to the hip of the user, and the direction of the loading force being approximately opposite the direction of a motion of the hip of the user as the user extends the hip of the user from the hip flexed position to the hip extended position.

4. The method of performing an exercise routine of claim 3, wherein the resistance apparatus comprises resistance pegs or hooks adapted to attach to one or more resistance bands.

5. The method of performing an exercise routine of claim 4, wherein the resistance apparatus further comprises one or more resistance bands.

6. The method of performing an exercise routine of claim 3, wherein the resistance apparatus further comprises a weight stack structure.

7. The method of performing an exercise routine of claim 3, wherein the resistance apparatus further comprises a plate loading structure.

8. The method of performing an exercise routine of claim 3, wherein the resistance apparatus further comprises a pneumatic device.

9. The method of performing an exercise routine of claim 3, wherein the resistance apparatus further comprises a deflecting bow device such as a Bowflex® bow.

10. The method of performing an exercise routine of claim 3, further comprising working against the loading force of the resistance apparatus as the user moves from the hip flexed position to the hip extended position.

11. The method of performing an exercise routine of claim 1:

wherein the exercise apparatus further comprises a foot support, the foot support being adapted to support a mass of at least 80 kilograms at a height of at least 25 cm above a surface on which the exercise apparatus rests, and the foot support being disposed at least 75 cm, but no more than 150 cm, from the upper body support; and further comprising placing the at least one foot of the user on the foot support.

12. The method of performing an exercise routine of claim 3:

wherein the exercise apparatus further comprises a foot support, the foot support being adapted to support a mass of at least 80 kilograms at a height of at least 25 cm above a surface on which the exercise apparatus rests, and the foot support being disposed at least 75 cm, but no more than 150 cm, from the upper body support; and further comprising placing the at least one foot of the user on the foot support.

13. A method of performing an exercise routine comprising:

providing an exercise apparatus, the exercise apparatus including:

an upper body support, the upper body support being adapted to support a mass of at least 80 kilograms at a height of at least 25 cm above a surface on which the exercise apparatus rests;

a foot support, the foot support being (i) adapted to firmly support a mass of at least 80 kilograms at a height of at least 25 cm above a surface on which the exercise apparatus rests, and, (ii) coupled to the upper body support, and (iii) disposed at least 75 cm, but no more than 150 cm, from the upper body support;

an exercise space comprising a three dimensional space, the exercise space (i) being disposed substantially between the upper body support and the foot support, (ii) extending between the upper body support and the foot support along a straight line between the upper body support and the foot support, (iii) extending at least 50 cm in an upward direction from a point on the straight line between the upper body support and the foot support, the point being equidistant between the upper body support and the foot support, and the first direction being substantially perpendicular to the straight line between the upper body support and the foot support, (iii) extending at least 50 cm in a second direction from the point on the straight line between the upper body support and the foot support, the point being equidistant between the upper body support and the foot support, the second direction being substantially opposite the first direction, and (iv) being substantially empty of exercise apparatus components;

placing an upper back of a user directly on the upper body support; placing a hip of the user below the upper body support; placing a foot of the user directly on the foot support; and supporting a substantial entirety of a body weight of the user on the upper body support and the foot support.

14. The method of claim 13, further comprising:

assuming a hip flexed position, the hip flexed position comprising;

the upper back of the user residing against the upper body support;

the substantial entirety of the body weight being supported by the upper back of the user and the foot of the user;

a femur angle of the user being about 90°.

15. The method of claim 14, further comprising:

extending the hip of the user to a hip extended position, the hip extended position comprising;

the upper back of the user residing against the upper body support;

the substantial entirety of the body weight being supported by the upper back of the user and the at least one foot of the user; and the femur angle of the user being at about an angle of 180°.

16. The method of claim 15, wherein the hip flexed position further comprises a knee of the user being bent at an angle of about 90° and said extending the hp of the user to the hip extended position further comprises the knee of the user remaining bent at an angle of about 90°.

17. The method of claim 13, wherein the distance between the upper body support and the foot support is at least 91 cm.

18. The method of claim 17, wherein the distance between the upper body support and the foot support is at least 107 cm.

19. The method of claim 13, wherein the distance between the upper body support and the foot support is readily adjustable from a minimum distance of not less than 91 cm to a maximum distance of not more than 130 cm.

20. The method of claim 17, wherein the upper body support comprises a top portion consisting essentially of a padded, convex upper surface.

* * * * *